US011484458B2

(12) United States Patent
Kwaśniewski et al.

(10) Patent No.: US 11,484,458 B2
(45) Date of Patent: Nov. 1, 2022

(54) DEVICE FOR SPINE REHABILITATION AND METHOD OF SPINE REHABILITATION USING SAID DEVICE FOR SPINE REHABILITATION

(71) Applicant: AKADEMIA GÓRNICZO-HUTNICZA IM. STANISŁAWA STASZICA W KRAKOWIE, Cracow (PL)

(72) Inventors: Jerzy Kwaśniewski, Cracow (PL); Szymon Molski, Cracow (PL)

(73) Assignee: Akademia Gorniczo-Hutnicza Im. Stanislawa Staszica w Krakowie, Cracow (PL)

( * ) Notice: Subject to any disclaimer, the term of this patent is extended or adjusted under 35 U.S.C. 154(b) by 35 days.

(21) Appl. No.: 17/037,699

(22) Filed: Sep. 30, 2020

(65) Prior Publication Data

US 2021/0100712 A1 Apr. 8, 2021

(30) Foreign Application Priority Data

Oct. 4, 2019 (PL) ..... 431381

(51) Int. Cl.
*A61H 1/02* (2006.01)
*A61H 1/00* (2006.01)

(52) U.S. Cl.
CPC ..... *A61H 1/0229* (2013.01); *A61H 1/00* (2013.01); *A61H 1/001* (2013.01); *A61H 1/003* (2013.01);
(Continued)

(58) Field of Classification Search
CPC ..... A61H 1/00; A61H 1/001; A61H 1/003; A61H 1/005; A61H 1/02;
(Continued)

(56) References Cited

U.S. PATENT DOCUMENTS 5,192,304 A * 3/1993 Rassman ..... A61H 9/0078 5/933
6,098,216 A * 8/2000 Williamson ..... A61G 7/1055 177/144
(Continued)

FOREIGN PATENT DOCUMENTS

EP 2311424 A1 4/2011
PL 176238 B1 5/1999
(Continued)

*Primary Examiner* — Justine R Yu
*Assistant Examiner* — Alexander Morales
(74) *Attorney, Agent, or Firm* — Andrzej Malarz, Esq.

(57) ABSTRACT

A device for spine rehabilitation comprising a support frame, immovable crossbars, movable crossbars, and a holder and systems of actuators supporting a patient's head, shoulders, hip, knees, and feet, characterised in that it is equipped with linear actuators (8) mounted to the holder (7) supporting the patient's head and shoulders, whereby the holder (7) has a driving mechanism (9) situated horizontally and mounted to an immovable crossbar (6) of the support frame (1) and in its lower part is rotationally mounted, at the rotation point (10) of the holder, to the immovable crossbar (6). A method for spine rehabilitation using the device for lateral deviation of the patient's torso, whereby the patient's body situated horizontally, face up, is lifted on eight sling hangers taking hold of his/her head and his/her back in the points of shoulder girdle and pelvis girdle.

4 Claims, 1 Drawing Sheet

(52) U.S. Cl.
CPC ..... *A61H 1/005* (2013.01); *A61H 1/02* (2013.01); *A61H 1/0292* (2013.01); *A61H 2001/0203* (2013.01); *A61H 2001/0207* (2013.01); *A61H 2001/0233* (2013.01); *A61H 2201/0157* (2013.01); *A61H 2201/0192* (2013.01); *A61H 2201/123* (2013.01); *A61H 2201/163* (2013.01); *A61H 2201/1607* (2013.01); *A61H 2201/1616* (2013.01); *A61H 2201/1642* (2013.01); *A61H 2201/1664* (2013.01); *A61H 2201/1676* (2013.01); *A61H 2201/5007* (2013.01); *A61H 2203/0443* (2013.01); *A61H 2203/0456* (2013.01); *A61H 2203/0481* (2013.01); *A61H 2205/081* (2013.01)

(58) Field of Classification Search
CPC .... A61H 2001/0203; A61H 2001/0207; A61H 1/0214; A61G 7/0005; A61G 7/1015; A61G 7/1046; A61G 7/1051; A61G 7/008; A61G 13/04; A47C 21/006; A63B 7/00–02; A63B 21/068; A63B 21/008–0083; A63B 21/0085–0087; A63B 2023/003–006; A63B 2208/0285
USPC ..... 606/234, 232, 239; 5/607
See application file for complete search history.

(56) References Cited

U.S. PATENT DOCUMENTS 6,971,997 B1 * 12/2005 Ryan ..... A61F 5/04 602/32
7,648,473 B1 * 1/2010 Peruvingal ..... A61H 1/0222 601/24
7,704,200 B2 * 4/2010 Rahimi ..... A61H 1/0229 482/148
8,257,285 B2 * 9/2012 Cook ..... A61H 1/0218 5/915
10,219,965 B2 * 3/2019 Davis ..... A61G 13/121
11,179,284 B2 * 11/2021 Stocker ..... A61G 7/1003
2005/0255971 A1 * 11/2005 Solomon ..... A63B 23/03541 482/54
2007/0251010 A1 * 11/2007 Lara ..... A61H 37/00 5/620
2009/0255543 A1 * 10/2009 Oyama ..... A61H 1/0292 128/898
2010/0144504 A1 * 6/2010 Kreil ..... A61H 1/0229 482/143
2013/0085531 A1 * 4/2013 Hartman ..... A61H 1/02 606/245
2013/0184615 A1 * 7/2013 Johnson ..... A61H 1/0296 601/18
2014/0342877 A1 * 11/2014 Rakhmatullin .... A63B 21/0085 482/4
2015/0320635 A1 * 11/2015 Viscomi ..... A63B 23/03541 482/54

FOREIGN PATENT DOCUMENTS

PL 60060 Y1 12/2003
PL 209439 B1 9/2011
PL 217824 B1 8/2014
PL 226008 B1 6/2017
WO 2007/017282 A2 2/2007

* cited by examiner

DEVICE FOR SPINE REHABILITATION AND METHOD OF SPINE REHABILITATION USING SAID DEVICE FOR SPINE REHABILITATION

CROSS REFERENCE TO RELATED APPLICATIONS

This application claims priority of Polish Patent Application No.: P.431381, filed on Oct. 4, 2019. The contents of Polish Patent Application P.431381 is hereby incorporated by reference.

FIELD OF THE INVENTION

This disclosure relates to a device for spine rehabilitation, particularly for patients with painful postural asymmetry, discopathy and degenerative illnesses and a method for spine rehabilitation using said device for spine rehabilitation.

BACKGROUND

From the description of Polish utility model No PL 60060 there is known a derotational-corrective-redressive device for treating scoliosis, used for active exercise, which is constructed from two frames, frontal and rear, connected at their upper part by guides on which slides are put on. In the lower part of the frontal frame there is mounted a support for hands to which a head hoist is attached and, above, on the rear frame, there is a knee support mounted to which a hip hoist is attached. Two connecting members stabilize the whole device. While exercising on the device a patient, in a supported kneeling position, is stabilized by shoulder blockades and a hip blockade. The patient while performing an exercise called "cat-cow pose" has his/her rib prominence and lumbar bump blocked at their apex by projections in pads which, during the exercise, press against the spine along the curve of the circular sector causing derotation, correction and redression of twisted arches of the spine that is deformed in those places. The other solution that has been disclosed in Polish invention No PL 176238 relates to a scoliosis correcting adjuster which comprises a rectangular base with vertical protrusions on one side of the longer flanks on which a crossbar is retractably mounted whose lift is adjustable along the line perpendicular to the base and along a line running at an acute angle to the base, whereas to the other side of the base there is a blocking plate mounted slidingly and dismountably to its longer flank. To a shorter flank of the base on the opposite side of the vertical protrusions an elastic line is attached which traverses through cut-outs in the longer flanks of the base and which has handles attached to its ends. Moreover, the base is equipped with a belt placed slidingly in cut-outs made in the bottom of the longer flanks of the base.

From Polish patent PL 209439B1 description there is known a device comprising four separate supports supporting a patient—in a substantially horizontal position—his/her head, back in the points of shoulder girdle and pelvis girdle, and calves. These supports are mounted on a frame bearer by ball units which can swing in relation to the long axis of the spine and move vertically and be locked in a chosen position. Angle and level settings of each support introduces required shifts of the vertebra diagonally within anatomical range of the movement. Also, from Polish patent PL 226008B1 there is known a device for stimulation of muscles and rehabilitation of backbone, particularly for patients with painful postural asymmetry, discopathy and degenerative illnesses. The essence of the invention consists in that each sling hanger at its end is connected to linear actuators which are suspended in pairs from the horizontal support frame in the position perpendicular to the axis of the spine, and the movement of each of the linear actuators is individually controlled by the computerized medical control system software. And European application EP 2311424A1 discloses a device for physiotherapy and rehabilitation having a robust supporting structure in the form of a horizontal frame propped at its corners, having four cross elements out of which two middle are slidingly mounted on longitudinal rods of the frame and whose position can be adjusted. Suspended on internal rods there is a longitudinal member which can be pivoted horizontally. Cross-rods slidingly attached to the longitudinal member have on them mechanisms for fitting and adjusting length of slide lines on which the patient's body is suspended. Thanks to additional horizontal lines attached to the sling hanger it is possible to exert force acting along the axis of the spine.

From publication WO 2007/017282A2 there is known an exercise apparatus having, in one of the embodiments of its frame design, a rod structure. The frame is suspended on the ceiling in a way that it can be rotated horizontally and vertically thanks to the use of a ball-and-socket joint and also lifted and lowered thanks to the use of a telescopic member. The frame has a longitudinal supporting member in the form of double rods or tubes. This member also acts as a guide for linear carriages with linear bearings that can move along it. Cross-rods fitted to the carriages have on their ends elements in the form of blocks or eyelets whose position on the rods can be adjusted and locked and which are designed for placing sling hangers on which patient's body is suspended above a bed. Moving parts can be power-driven, for example by an electric motor.

Moreover, from Polish patent description No PL 217824 there is known a device for scoliosis treatment having a main frame in the shape of a cuboid with legs. Upper arms of the frame are connected with an upper beam to which an upper rod is attached by a ball-and-socket joint. Lower arms of the main frame are connected by a lower beam to which a lower rod is attached by a ball-and-socket joint. The upper rod has hand grips and the lower rod has platforms for feet of a person performing exercise. There are upper tightening members attached at the ends of the upper rod, and lower tightening members attached to the lower rod.

The object of the invention is to develop a device allowing to introduce a movement of lateral deviation of the patient's torso during his/her rehabilitation in suspension and a method for carrying out spine rehabilitation using said device.

A device for spine rehabilitation with the use of a method for lateral deviation of the patient's torso comprising a support frame, immovable crossbars, movable crossbars and a holder and actuator assemblies supporting the head, the arms, the hips, the knees and the feet of the patient characterised in that it is equipped with linear actuators mounted on the holder and to the movable crossbars that support the patient, whereby the holder has a driving mechanism, sliding horizontally, mounted on the immovable crossbar of the holder of the supporting frame and which, on its lower part, is fitted to the immovable crossbar equipped with a rotating mechanism. The holder's upper back surface moves on rolling members installed in the immovable crossbar of the holder. Sling hangers for the head and for the shoulders connected on their ends with two linear actuators are suspended on the movable holder. Moreover, the movement of each of the actuators is controlled individually from a control unit assisted by a computer with medical software. Preferably, the linear actuators for each of the sling hangers are connected with the holder by slidable assemblies in the direction longitudinal to the axis of the holder and thus allow to adjust positions of the actuators of the sling hanger for the head according to anthropometric size of a particular patient.

A method for spine rehabilitation using the device for lateral deviation of the torso of the patient suspended on the actuators takes place in the device where the patient's body is situated in substantially horizontal position, face up, and is lifted by five sling hangers that take hold of the patient's head, back in the points of shoulder girdle and pelvis girdle, calves and feet and each of the slings is connected on its ends with two linear actuators suspended on the horizontal support frame in the position perpendicular do the axis of the patient's spine, whereby the movements of each of the linear actuators is individually controlled from the control system, characterised in that the head and the shoulders of the suspended patient are supported by the actuators fitted in the holder whose transversal movement is provided by the rotating mechanism, whereas a slidable mechanism moves along an arc within a designated range in such a way that the holder's upper surface moves with a swinging motion on the rolling members fitted in the crossbar of the supporting frame, whereas movements of the actuators connected to the surface of the holder cause lateral deviation of the torso and the spine at a designated angle with the possibility of selecting proper frequency and amplitude of the deviations.

The solution presented allows to carry out spine rehabilitation therapy in suspension with a dynamic lateral deviation of the torso optimally selected to a particular affection, with discretionarily varied, medically developed kinematics. The movements of the actuators connected to the surface of the holder produces lateral deviation of the torso and of the spine up to a specified deviation angle with the possibility of selecting an adequate frequency and amplitude of the relocation, and, additionally, with various options of the longitudinal interaction of neighbouring sling hangers. For example, with the sling hanger for the pelvis girdle locked, side bending is induced by activating the shoulder girdle sling hanger. This kind of rehabilitation therapy, thanks to this solution, becomes safe and less burdensome while keeping the patient in safety and comfort. The exemplary embodiment of the invention is shown on the accompanying diagrammatic drawings.

DETAILED DESCRIPTION OF THE PREFERRED EMBODIMENTS

Figure 1:
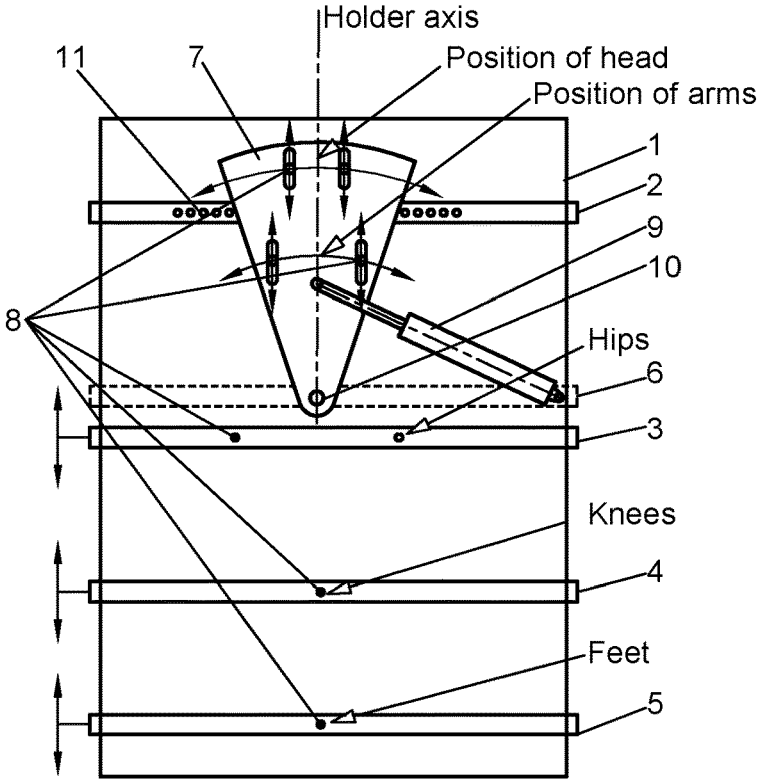
FIG. 1 shows main elements of the device according to the present disclosure in operational mode.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower", "upper", "horizontal," "vertical," "above," "below," "up," "down," "top" and "bottom" as well as derivative thereof (e.g. "horizontally," "downwardly," "upwardly," etc.) should be construed to refer to the orientation as then described or as shown in the drawing under discussion.

There relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both moveable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limited combination of features that may exist alone or in other combination of features; the scope of the invention being defined by the claims appended hereto. This disclosure describes the best mode or modules of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

FIG. 1 shows the embodiment of the device according to the invention which comprises a support frame 1 equipped with an immovable crossbar 2 of a holder, a movable crossbar 3 for the hip, a movable crossbar 4 for the knees, a movable crossbar 5 for the feet and an immovable crossbar 6 of the holder. The holder 7 is rotationally mounted on the immovable crossbar 6 by a slidable mechanism 9 for moving the holder along an arc, whereby its surface is moving along the immovable crossbar 2 on globular or rolling members 11 fitted therein. Actuators 8 holding the patient's head and shoulders are mounted to the holder 7 and to the movable crossbars 3, 4, 5. The transverse movement of the holder 7 is actuated by a driving mechanism 9 mounted on the immovable crossbar 6. Thanks to the robust support frame 1 the patient is stabilized and feels safe. The holder 7 mounted rotationally at the rotation point 10 of the holder on the crossbar 6 and moving on rolling members 11 allows to acquire and to secure a desired position with a lateral movement of the patient's torso. Slidable assemblies 12 allow to adjust the position of the actuators of the sling hangers for the head and for the shoulders to anthropometric size of a particular patient.

Figure 2:
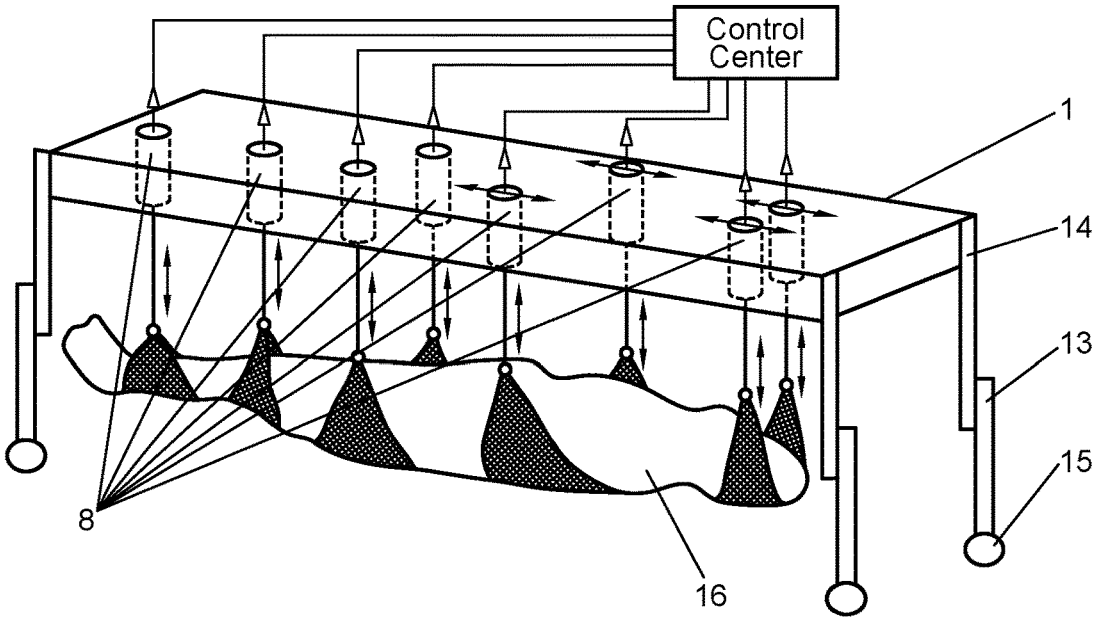
FIG. 2 shows frame with structural members connected by a lifting mechanism with track rollers.

In the corners of the frame 1 (FIG. 2) there are situated structural members 14 connected by a lifting mechanism 13 with track rollers 15. The torso of the patient 16 is laterally deviated in the device built on the track rollers 15 in such a manner that the body of the patient 16 situated horizontally, face up, is lifted by means of five sling hangers taking hold of the head, the back in the points of shoulder girdle and pelvis girdle, and the calves, and the feet. The suspensions of the head, the shoulders, and the hip are at their ends connected with the linear actuators 8 suspended on the horizontal support frame 1 transversely to the axis of the patient's spine. The movement of each of the linear actuators is individually controlled from a control system 17.

The head and the shoulders of the suspended patient (FIG. 1) are supported by the linear actuators 8 mounted to the holder 7 whose transversal movement is provided by the holder's driving mechanism 9 along an arc within a designated range of the movement. The holder's 7 upper back surface moves with a swinging motion on the rolling members 11 installed in the immovable crossbar 2 of the support frame 1. Repositioning of the holder's drive (for example an actuator) which connects the holder 7 and the immovable crossbar 6 causes lateral deviation of the torso and the spine to a designated angle with the possibility for selecting an adequate frequency and amplitude of the relocation as set in the control system 17.

The device allows for a precise, three-plane correction of scoliosis. Thanks to the lateral deflection of the spine with the patient in horizontal position on the movable base and also thanks to the three-plane stabilization of the hip in the transverse plane and in the sagittal plane a correction of the spine takes place.

Thanks to its design the device according to the invention allows for spinal correction in three planes and makes it possible to treat in a correct manner scoliosis, rheumatic and neurological diseases. Scoliosis that are improperly treated might lead to a reduced physical capacity of the patient, increased intensity of neurological disorders, permanent disability, and in extreme cases to heart or/and respiratory failure and premature death.

The device according to the invention might be useful to improve efficiency of spine rehabilitation therapy, might be used in rehabilitation centres, in companies producing medical equipment as well as in hospital rehabilitation wards. It is targeted for physiotherapists in order to improve and create new possibilities of working with the patient substantially decreasing energy expenditures in the process of patient rehabilitation.

While the present invention has been described at some length and with some particularity with respect to the several described embodiments, it is not intended that is should be limited to any such particulars or embodiments or any particular embodiment, but it is to be construed with references to be appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

LIST OF REFERENCE NUMERALS

1—Support frame
2—Immovable crossbar of the holder
3—Movable crossbar (for the hip)
4—Movable crossbar (for the knees)
5—Movable crossbar (for the feet)
6—Immovable crossbar of the holder
7—Holder
8—Linear actuators
9—Driving mechanism of the holder
10—Point of rotation of the holder
11—Rolling members
12—Slidable assemblies of the actuators
13—Lifting mechanism
14—Structural members
15—Track rollers
16—The patient
17—Control system

The invention claimed is:

1. A device for spine rehabilitation comprising:
a support frame,
first and second immovable crossbar,
movable crossbars,
a holder,
systems of actuators for supporting a patient's head, shoulders, hip, knees, and feet, wherein the systems of actuator are equipped with
linear actuators (8) mounted to the holder (7) and the movable crossbars supporting the patient's head and shoulders, whereby the holder (7) has
a driving motor (9) situated horizontally and mounted to the second immovable crossbar (6) of the support frame (1) and in a lower part the holder is rotationally mounted, at a rotation point (10) of the holder, to the immovable crossbar (6), wherein on the first immovable crossbar (2) of the holder (7) there are balls or rollers (11) which allow for a smooth movement of the holder (7) in the horizontal plane, wherein the holder (7) is equipped with
slidable actuators (12) allowing the device to be adjusted to an anthropometric size of the patient, wherein
sling hangers are connected on both ends of the sling hangers with linear actuators mounted to the holder (7), and wherein
the support frame (1), having structural elements (14), is moved vertically by a lifting actuator (13), and moves horizontally on track rollers (15).

2. The device according to claim 1, wherein an upper back surface of the holder (7) moves on the rollers (11) installed in the first immovable crossbar (2) of the holder.

3. A method for spine rehabilitation using a device for lateral deviation of a patient's torso comprising:
situating a patient's body horizontally, face up, on five sling hangers mounted to a holder (7),
lifting the patient's head and back on five sling hangers holding the patient's head and back in a space around a shoulder girdle and a pelvis girdle, calves and feet, wherein
each of the sling hangers holding the patient's head and back in a space around the shoulder and pelvis girdles is connected on both ends of each sling hanger with two linear actuators mounted to the holder (7) and hanging downwardly attached to a horizontal support frame (1) in a position perpendicular to an axis of a patient's spine, wherein
each of the sling hangers holding the patient's calves and feet
is connected on both ends of each sling hanger with one linear actuator hanging downwardly attached to movable crossbars of the horizontal support frame (1) in the position perpendicular to the axis of the patient's spine,
controlling individually a movement of each of the linear actuators from a control system (17), with assistance of a computer with medical software,
carrying out a lateral movement of the patient (16) suspended on the linear actuators (8) and sling hangers holding the patient's head and back in the space around the shoulder and pelvis girdles, by a movement of the holder (7) moved by a driving motor (9) along an arc within a designated range of the movement of the holder (7), whereby the holder (7) has the driving motor (9) situated horizontally and mounted to a first immovable crossbar (6) of the support frame (1) and in a lower part the holder is rotationally mounted, at a rotation point (10) of the holder, to the first immovable crossbar (6), wherein on a second immovable crossbar (2) of the holder (7) there are balls or rollers (11) which allow for the smooth movement of the holder (7) in the horizontal plane, wherein the holder (7) is equipped with slidable actuators (12) allowing the device to be adjusted to an anthropometric size of the patient, and wherein the horizontal support frame (1), having structural elements (14), is moved vertically by a lifting actuator (13), and moves horizontally on track rollers (15).

4. The method according to claim 3, further comprising the following steps:

setting a proper frequency and amplitude of a relocation set in the control system (17), selecting a proper frequency and amplitude of the relocation set in the control system (17), causing by the driving motor (9) a lateral deviation of the patient's (16) torso up to a designated angle of deviation wherein the head and the shoulders of the suspended patient are supported by the linear actuators (8) mounted to the holder (7) whose transversal movement is provided by the driving motor (9) which moves the holder along the arc within a designated range in such a way that the holder (7) moves with a swinging motion on the rollers (11) fitted in the immovable crossbar (2) of the supporting frame (1), whereas movements of each of the linear actuators (8) connected to the holder (7) cause the lateral deviation of the torso and the spine to be at a designated deviation angle with the selected proper frequency and amplitude of the relocation set in the control system (17).

* * * * *